US005195804A

United States Patent [19]

Stolle et al.

[11] Patent Number: 5,195,804

[45] Date of Patent: Mar. 23, 1993

[54] BACK-REST HAVING TWO OVAL SHAPED SHELLS EACH CONCAVE TO VERTICAL AND CONVEX TO HORIZONTAL

[76] Inventors: Herbert D. Stolle, Gustav-Adolf-Strasse 37a, D-2000, Hamburg 70; Matthias Brünig, Diekbarg 48, D-2000, Hamburg 65, both of Fed. Rep. of Germany

[21] Appl. No.: 466,349

[22] PCT Filed: Jul. 15, 1989

[86] PCT No.: PCT/EP89/00826

§ 371 Date: Mar. 6, 1990

§ 102(e) Date: Mar. 6, 1990

[87] PCT Pub. No.: WO90/00873

PCT Pub. Date: Feb. 8, 1990

[30] Foreign Application Priority Data

Jul. 19, 1988 [DE] Fed. Rep. of Germany ..... 3824461

[51] Int. Cl.[5] ..... A47C 7/02

[52] U.S. Cl. ..... 297/460; 297/306

[58] Field of Search ..... 297/460, 296, 312, 353, 297/354, 306, 300, 297, 298, 284 R, 284 B, 284 C, 284 G

[56] References Cited

U.S. PATENT DOCUMENTS

| | | | |
|---|---|---|---|
| 256,711 | 4/1882 | Liscomb | 297/306 |
| 371,402 | 10/1887 | Williamson | 297/460 |
| 1,011,026 | 12/1911 | Carpenter | 297/460 |
| 1,976,326 | 10/1934 | Carlton | 297/312 |
| 2,117,821 | 5/1938 | Parker | 297/455 |
| 2,796,920 | 6/1957 | Cowles | 297/460 |
| 2,847,062 | 8/1958 | Hendrickson et al. | 297/460 |
| 2,858,876 | 11/1958 | Woodson, Jr. | 297/353 |
| 2,970,638 | 2/1961 | Halter | 297/460 |
| 3,063,752 | 11/1962 | Moore | 297/411 |
| 4,471,993 | 9/1984 | Watson | 297/460 |

FOREIGN PATENT DOCUMENTS

| | | | |
|---|---|---|---|
| 0018423 | 11/1980 | European Pat. Off. . | |
| 1121944 | 9/1958 | Fed. Rep. of Germany . | |
| 1264703 | 2/1964 | Fed. Rep. of Germany . | |
| 1282264 | 3/1966 | Fed. Rep. of Germany . | |
| 2049666 | 10/1970 | Fed. Rep. of Germany . | |
| 2123081 | 5/1971 | Fed. Rep. of Germany . | |
| 1383559 | 2/1964 | France . | |
| 809095 | 2/1959 | United Kingdom | 297/300 |
| 925337 | 5/1961 | United Kingdom . | |
| WO860138 | 5/1986 | World Int. Prop. O. . | |

*Primary Examiner*—Kenneth J. Dorner
*Assistant Examiner*—James M. Gardner
*Attorney, Agent, or Firm*—David L. Davis

[57] ABSTRACT

A backrest for stools, seats, chairs, and the like, characterized by two backrest shells (1) that are arranged at the sides and are configured in the manner of the contact surfaces of equestrian saddles, these being configured so as to be concave with reference to an axis that is essentially perpendicular to the seating surface (20), and so as to be convex with reference to a horizontal axis above the seating surface (20).

5 Claims, 1 Drawing Sheet

(A-B)

BACK-REST HAVING TWO OVAL SHAPED SHELLS EACH CONCAVE TO VERTICAL AND CONVEX TO HORIZONTAL

BACKGROUND OF THE INVENTION

The present invention relates to a backrest for a chair, seat, stool, or the like.

Backrests for chairs, automobile seats, and the like that incorporate side pieces that fit beneath the armpits and thus support the spine are known (DE-PS 12 82 264). Such seats can also be configured as folding seats when they are used in automobiles (DE-OS 20 49 666), such seats automatically deploying when sat upon. None of these backrests have been accepted because they were to costly to produce and they did not off the required degree of comfort.

It is the task of the present invention to configure a backrest so that the spine of a seat person is effectively relieved of stress, this taking place both in the case of longer periods when seated in changing positions and also when widely differing physical characteristics of the individuals using the seats are involved.

SUMMARY OF THE INVENTION

The invention provides a backrest for stools, seats, chairs, and the like, characterized by two backrest shells that are laterally spaced and are configured in the manner of the contact surfaces of equestrian saddles, so as to be horizontally concave and vertically convex towards the front, a spring element being secured between a support rail and each backrest shell so as to provide a positive connection.

The underlying concept of the present invention lies in the special configuration of the seat shells. A configuration of this kind means that despite varying physical characteristics, persons using the seat are always supported, which is of particular importance in the case of automobile seating, since lateral forces must also be accommodated by the backrest, and this can be done in an anatomically effective manner by the backrest according to the present invention, so that the pelvic and lumbar regions are relieved of stress.

The present invention proposes a backrest that, in addition to being simple to produce, also offers a high level of comfort and adequate support for the spine. In addition, this backrest adapts to the physical dimensions of various users.

BRIEF DESCRIPTION OF THE DRAWINGS

The present invention is described in greater detail below on the basis of the drawings appended hereto. These show the following.

DETAILED DESCRIPTION

Figure 1:
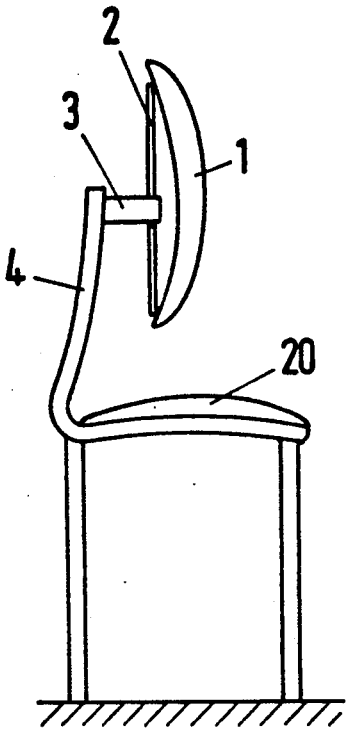
FIG. 1 A side view of a backrest according to the present invention.
Figure 2:
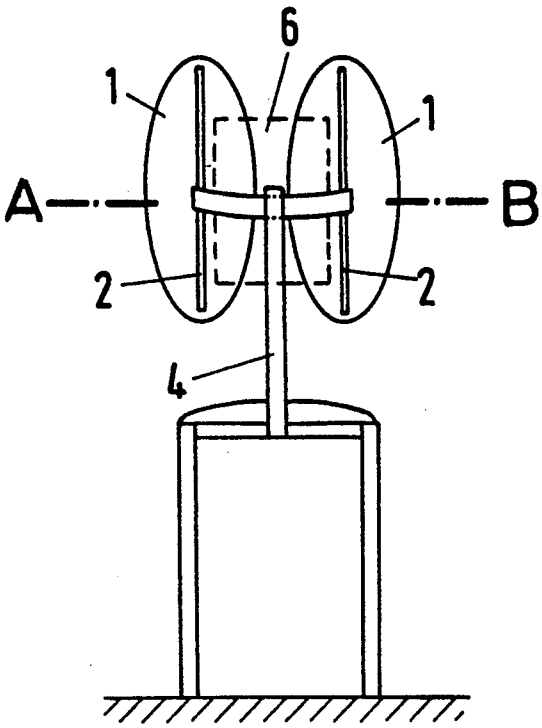
FIG. 2 A rear view of the backrest shown in FIG. 1.
Figure 3:
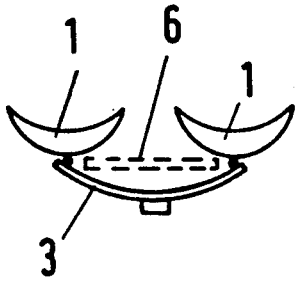
FIG. 3 A cross section on the line A–B in FIG. 2.

The backrest consists of two backrest shells 1 (FIGS. 1 to 3), that are held by a spring rod 2 through carrier rails 3 and 4. These shells are shaped so as to be concave to the body around the vertical axis (FIG. 3), whereas they are convex about a transverse horizontal axis (FIG. 1). In other words, the shells are horizontally concave and vertically convex towards the front side. Each spring rod 2 is connected at or near its midpoint with a retaining or transverse rod 3 so as to form a shape-locking fit. The transverse rail 3 can, optionally, be connected to a vertical carrier rail 4 of a chair so as to be adjustable in height.

In order to provide for greater comfort, there can be a pad 6 fitted in front of or behind the backrest shells 1; if this pad is fitted behind the shells 1, it is preferred that it be attached elastically to the spring rods 2.

When the user leans back against the backrest, there backrest shells fold under the ribcage and the armpits of the person who is seated, thereby supporting the spine. The backrest shells can, however, rotate about the horizontal axis, if the user wishes to lean right back. In this case, the spring rods 2 are stressed so as to flex. A lateral elastic flexing of the backrest shells 1 is also possible, when an elastic lengthening of the spring rods 2 that is coupled with flexing at the point of attachment also takes place.

Figure 4:
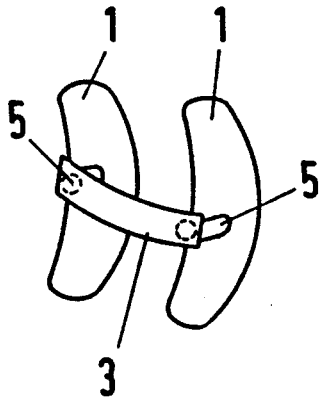
FIG. 4 A perspective rear view of a part of a modified embodiment of a backrest according to the present invention.

A similar mobility can be achieved if one connects the backrest shells to the transverse rod 3 only with rubber cylinders 5 (FIG. 4).

Accordingly, there have been disclosed improved backrests. It is understood that the above-described embodiments are merely illustrative of the application of the principles of this invention. Numerous other embodiments maybe devised by those skilled in the art without departing from the spirit and scope of this invention, as defined by the appended claims.

We claim:

1. Backrest characterized by two backrest shells (1), the shells being laterally spaced and configured so as to be substantially oval-shaped and elongated in the vertical direction when viewed in elevation as well as being concave with respect to an axis vertical to a seat surface (20) and convex with respect to a transverse horizontal axis arranged above the seat surface (20) a transverse rail (3), and means for resiliently connecting each backrest shells to each be rotatable about so as to enable said backrest shells to each be rotatable about three spatial axes.

2. Backrest as defined in claim 1 further characterized in that for each of the backrest shells, said resilient connecting means includes a spring element (5) extending from said transverse rail to a central portion of the backrest shell.

3. Backrest as defined in claim 2 further characterized in that said spring element comprises a cylinder formed of rubberlike material.

4. Backrest as defined in claim 1 further characterized in that for each of the backrest shells, said resilient connecting means includes a spring rod (2) having its ends connected to the upper and lower ends of the backrest shell and an intermediate portion connected to the transverse rail.

5. Backrest as defined in claim 1 further characterized by a substantially vertically oriented pad (6) positioned proximate the backrest shells.

* * * * *

UNITED STATES PATENT AND TRADEMARK OFFICE

CERTIFICATE OF CORRECTION

PATENT NO. : 5,195,804

DATED : March 23, 1993

INVENTOR(S) : Herbert D. Stolle and Matthias Brunig

It is certified that error appears in the above-identified patent and that said Letters Patent is hereby corrected as shown below:

Col. 2, claim 1, should read as follows:

Backrest characterized by two backrest shells (1), the shells being laterally spaced and configured so as to be substantially oval-shaped and elongated in the vertical direction when viewed in elevation as well as being concave with respect to an axis vertical to a seat surface (20) and convex with respect to a transverse horizontal axis arranged above the seat surface (20), a transverse rail (3), and means for resiliently connecting each back-rest [shells to each be rotatable about] <u>shell (1) to said transverse rail (3)</u> so as to enable said back-rest shells to each be rotatable about three spatial axes.

Signed and Sealed this

Sixteenth Day of November, 1993

Bruce Lehman

*Attest:*

BRUCE LEHMAN

*Attesting Officer*

*Commissioner of Patents and Trademarks*